United States Patent [19]

Turner

[11] 4,380,333

[45] Apr. 19, 1983

[54] SHEET MATERIAL GUIDING MEANS

[75] Inventor: George F. A. M. Turner, Ingatestone, England

[73] Assignee: Ciba-Geigy AG, Basel, Switzerland

[21] Appl. No.: 239,714

[22] Filed: Mar. 2, 1981

[30] Foreign Application Priority Data

Mar. 12, 1980 [GB] United Kingdom ..... 8008364

[51] Int. Cl.[3] ..... B65H 5/02

[52] U.S. Cl. ..... 271/272; 378/181

[58] Field of Search ..... 271/272, 273, 274; 226/189; 193/35 R; 250/468

[56] References Cited

U.S. PATENT DOCUMENTS

| | | | |
|---|---|---|---|
| 3,724,629 | 4/1973 | Collins | 193/35 R |
| 3,726,590 | 4/1973 | Kistner | 271/272 X |
| 3,840,102 | 10/1974 | Dawson | 193/35 R |
| 4,195,832 | 4/1980 | Krumrey | 271/272 X |
| 4,245,835 | 1/1981 | Turner | 271/272 X |

*Primary Examiner*—Richard A. Schacher

*Attorney, Agent, or Firm*—Harry Falber

[57] ABSTRACT

An apparatus for storing or processing sheet material is described. There are present in the entry chute several pairs of wheels of equal circumference mounted fixedly on free-running axles which are transverse to the path of travel of the sheet material. The rims of the wheels are covered in rubber. As the sheet material comes into contact with the wheels, the wheels guide the film sheet in a straight path.

5 Claims, 3 Drawing Figures

SHEET MATERIAL GUIDING MEANS

This Invention relates to an apparatus for storing or processing sheet material, said apparatus having an entry chute.

Sheet material is often fed into apparatus for storing the sheet material or for processing via an entry chute into which the sheet material is either allowed to fall by gravity or is fed slowly. The essential feature of the chute is that the whole length of sheet material can be accomodated therein. However storage or processing apparatus often store or process sheet material of different sizes and thus the width of the chute must be enough to accommodate the largest width of the sheet material which can be stored or processed in the apparatus. This means that the chute will be wide compared with the width of the narrowest sheet material which can be stored or processed in the apparatus and such material when fed into the chute will often tend to drop through the chute at an angle and not with its sides parallel to the side walls of the chute. When this happens trouble is often experienced in the storage or processing portion of the apparatus. We have now discovered a means for guiding sheet material in an entry chute.

According to the present invention there is provided an apparatus for storing or processing sheet material which comprises a gravity-feed entry chute wherein the sheet material is brought into frictional contact with at least one pair of wheels of equal circumference mounted fixedly on a free-running non-driven axle which is transverse to the path of travel of sheet material in the chute, the rims of both wheels of a pair having a high-friction surface, the sheet material passing through the chute by gravitational attraction.

By high friction surface is meant a surface which will provide a coefficient of friction of at least 0.2 between the wheels and the sheet material which is usually smooth-surfaced, for example film material. A useful high-friction material for use on the rim of the wheels is natural or synthetic rubber.

Preferably however the rubber or other high-friction surface material is loaded with an electrically conducting material, e.g. carbon. Most preferably the wheels are so mounted that any static electricity generated between the wheels and the sheet material is rapidly dissipated by conduction.

Preferably there are at least two pairs of mounted wheels arranged in staggered relationship so that sheet material which is passing the first pair of wheels is forced to press against this pair. Mounted below the said second pair of wheels there may be yet another pair of mounted wheels or a bowing means, either of which tend to cause the sheet material to press against the said second pair of wheels.

Most preferably mounted in the chute there are four sets of pairs of wheels, mounted in sets of two in staggered relationship.

As the sheet material enters the chute it is guided down by the pairs of mounted wheels so that it does not tilt towards one or other side of the chute. Most preferably therefore the pairs of wheels are so mounted that the sheet material is guided throughout its passage in the chute by pairs of mounted wheels.

There may be more than two wheels on each axle. Preferably each wheel on an axle is of the same circumference. However as the main function of the middle wheel if there are three wheels is to prevent the sheet material buckling as it passes the wheels this middle wheel may be of slightly smaller circumference than the other two.

The important feature of the apparatus of the present invention is that the sheet material passes by gravity through the chute and during its passage it drives the mounted wheels. However the wheels whilst being driven serve to guide the sheet material and prevent it tilting to one or other side of the chute.

In some prior art sheet material processing apparatus which comprise a chute, for example in U.S. Pat. Nos. 3,980,295, 3,834,040 and 2,721,078, the sheet material is driven through the chute by driven rollers or brushes. Driven wheels or brushes require complicated driving means to drive them and have been found in practice to be less effective than the freely rotatable non-driven wheels used in the apparatus of the present invention.

The apparatus of the present invention is of particular use for storing or processing X-ray film material. X-ray films are usually exposed in light-tight cassettes and in a recently introduced system the X-ray film is fed into the cassette, exposed in the cassette and removed from the cassette all in daylight conditions. Cassettes of use in such a system have a slot at one end for loading and unloading film sheet. Such a cassette is described in our published European patent application No. 522. An apparatus for receiving X-ray films from a cassette and storing the films just prior to processing is described in our published European patent application No. 4095. In FIG. 1 of No. 4095 the apparatus comprises an entry chute 6. The entry chute of the apparatus of the present invention is of particular use in the apparatus shown in FIG. 1 of E.P. No. 4095.

FIG. 1 is a cross-sectional diagrammatic side view of an apparatus according to the present invention. It is a modified drawing of FIG. 1 of European patent application No. 4095 and the same figures have the same signification. However for the sake of completeness the description of FIG. 1 as given in No. 4095 is given here as well. The difference is that the chute 6 of FIG. 1 of No. 4095 has been modified as later described.

Figure 1:
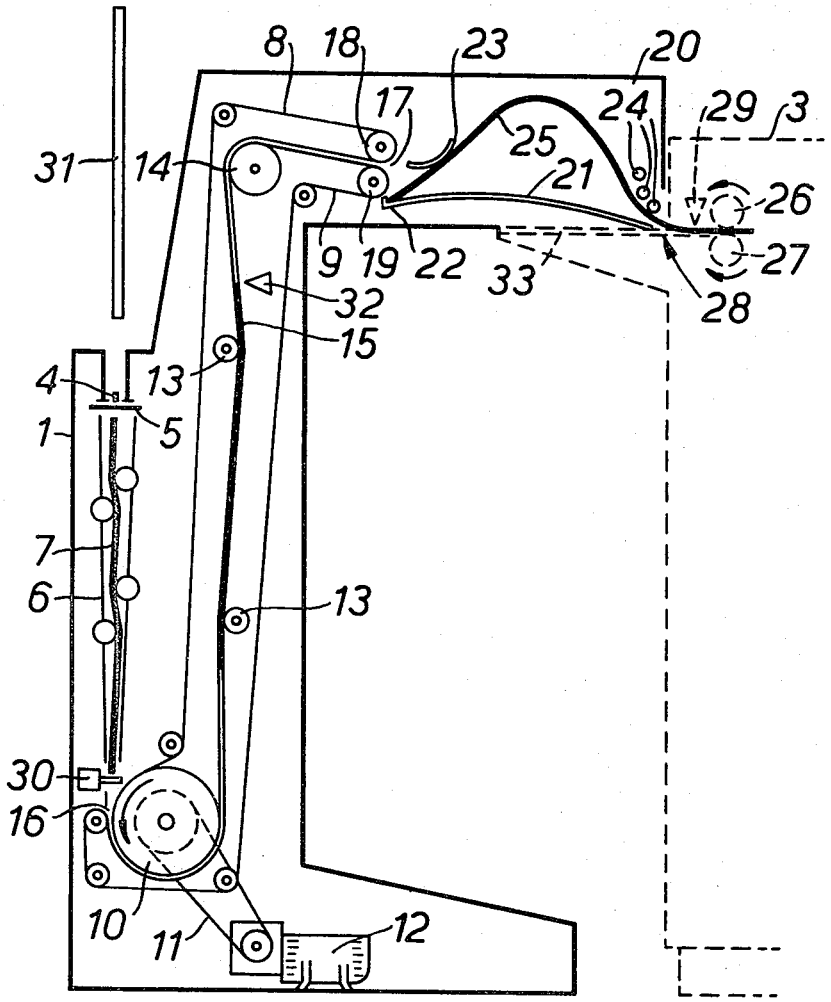

In FIG. 1 the apparatus comprises light-tight enclosure 1 and associated therewith, in a light-tight manner, a film processing apparatus 3 which is indicated by a dotted outline.

The light-tight enclosure 1 comprises a film cassette introduction port 4 and means 5 for closing off the film cassette introduction port 4 and rendering the light-tight enclosure 1 light-tight.

The light-tight enclosure 1 further comprises a pair or belt systems 8 and 9. This pair of belt systems are driven by a driven roller 10 which is in its turn driven by a belt 11 from a motor 12. The pair of belt systems 8 and 9 pass over a large number of rollers, some of which are indicated in the figure by the numeral 13. Each belt system comprises two narrow belts arrayed over each roller. From roller 10 to roller 14 the path of the pair of belt systems is substantially parallel and a film 15 is shown held therebetween. Also present in the light-tight enclosure 1 is a chute 6 in which a film 7 is shown stored. A film entrance port 16 is located below the chute 6. A film discharging port 17 is formed by the pair of nip rollers 18 and 19.

Figure 2:
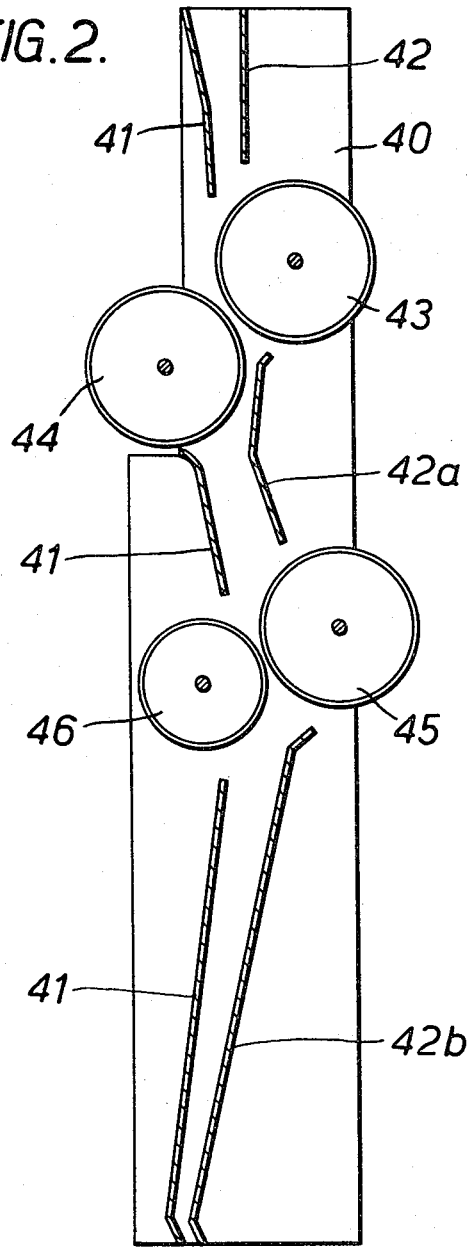
FIG. 2 is an enlarged cross-section side view of the chute 6 of FIG. 1.
Figure 3:
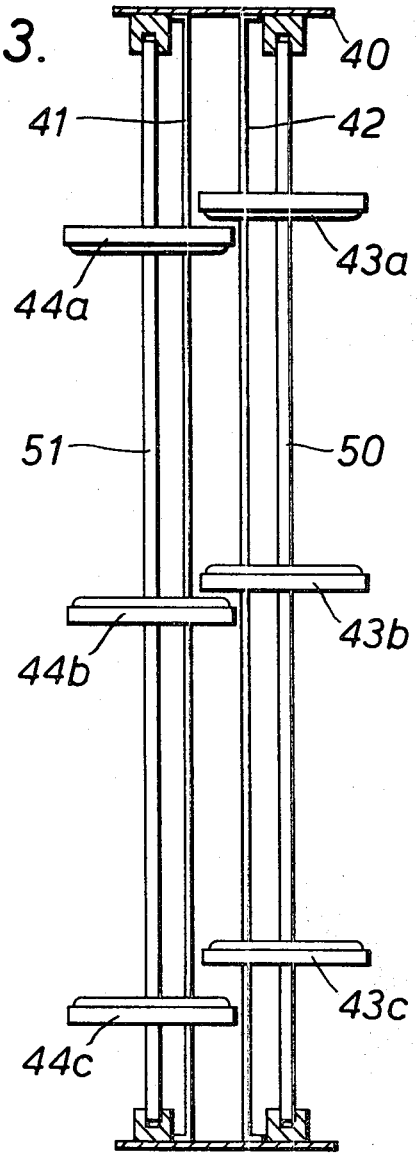
FIG. 3 is a top plan cross-sectional view of the chute of FIG. 2.

The chute 6 has outer walls 40 and inner walls 41 and 42. The inner walls are the film material guiding walls. Located across the path of the film material are four sets of free-rotating rollers 43, 44, 45 and 46 as shown in FIG. 2. Each set of rollers comprises three rollers mounted fixedly on an axle of which 50 and 51 are shown in FIG. 3. The letter suffixes indicate each individual roller in the set, e.g. set 43 has rollers 43*a*, 43*b* and 43*c*.

Inner walls 41 and 42 are not continuous walls as they have large slots therein at the positions of the four sets of rollers. Inner wall 42 is bowed in two sections (42*a* and 42*b*)as shown in FIG. 2. This is to urge sheet material passing through the chute to bear in frictional contact with the set of rollers located immediately thereabove.

The sets of rollers are set in staggered relationship as shown in FIG. 2. They may also be slightly off-set as shown in FIG. 3 but they have been off-set in this figure to show more clearly their location. In practice roller 44*a* (for example) is preferably located exactly in the same plane as roller 43*a*.

As the sheet of film 7 enters the chute from the cassette 31 it passes roller set 43 and causes the rollers of this set to rotate and guide it straight down to roller set 44 which in its turn guides the film sheet straight down past the top bowed portion of inner wall 42. The film sheet is still guided in a straight path until it encounters the set of rollers 45 which are then caused to rotate and guide the film sheet to a set of rollers 46. The film sheet continues to fall in an undeviating path until it reaches the bottom of the chute 6 which is closed by the solenoid 30.

By use of the modified chute of the apparatus of the present invention it is possible to guide film material of greatly differing widths without the smaller film sheet tending to fall crookedly.

The rims of all the rollers are covered in rubber loaded with carbon and the sets of rollers are mounted in an electrically conductive manner so that no build-up of static electricity can occur.

The operation of the remainder of the apparatus shown in FIG. 1 is now described for completeness.

Present between the film discharging port 17 and the processing apparatus 3 is the bowing section 20 of enclosure 1. The bowing section 20 comprises a curved platform 21 which has a channel 22 at end thereof. Arrayed over the curved platform 21 is a curved member 23 and an array of three rollers 24. Shown in a bowed position between the platform 21, the curved member 23 and the array of rollers 24 is a film 25. One end of the film 25 is shown between the pair of nip rollers 26 and 27 which constitute the entrance port of the film processor 3. The film exit port 28 is adjacent to the film processor 3.

At the entrance to the film processor 3 is shown a sensing means 29 which senses when the trailing edge of a film has passed therebeneath.

Also shown in FIG. 1 is a solenoid 30 which activates the closable means which shut off the bottom of the chute 6.

Shown above the cassette entry port 4 is a film cassette 31. Located along the parallel path of the belt systems 8 and 9 is a sensor 32. The curved platform 21 rests on a platform 33 of the processor 3.

In operation a film cassette 31 is introduced into the film cassette introduction port 4. This causes the closure means 5 to open and also opens the cassette 31. A film then falls out of the cassette 31 into the chute 6 where it is retained by the closure means associated with the solenoid 30. The motor 12 is then switched on and this causes the roller 10 to drive the pair of belt systems 8 and 9. This causes the solenoid 30 to be activated and the film sheet stored in the chute 6 falls into the film entrance port 16 and is carried by the pair of belt systems round to the film discharging port 17 where it is driven forward until its leading edge meets the pair of nip rollers 26 and 27 in the film processing machine 3. Further pressure exerted on it by the driven pair of belt systems causes the film to bow. When the trailing edge of the film 25 passes out of the film discharging port 17 the curved member 23 causes the trailing edge 25*a* to flip down into the channel 22, as shown in FIG. 1.

I claim:

1. In an apparatus for receiving a plurality of sheet films from film cassettes and presenting them in seriatim to an associated film processor, the apparatus comprising a light-tight enclosure having a film cassette introduction port being adapted to receive a film sheet from a cassette which is opened when its openable end is introduced therein, a film exit port located in light-tight operational contact with an associated film processor, and means for guiding the film from said introduction port to said exit port, the improvement wherein said guide means comprises an enclosed gravity-feed entry chute below the film cassette introduction port wherein the film sheet is brought into frictional contact with at least two pairs of wheels of equal circumference mounted fixedly on a free-running non-driven axle which is transverse to the path of travel of the film sheet, the pairs of wheels being mounted in sets of two in staggered relationship, the rims of both wheels of a pair having a high-friction surface, the film sheet passing through the chute by gravitational attraction.

2. An apparatus according to claim 1 wherein there are four sets of pairs of wheels, mounted in sets of two in staggered relationship.

3. An apparatus according to any one of claims 1 or 2 wherein the surface of the wheels is covered in natural or synthetic rubber.

4. An apparatus according to claim 3 wherein the rubber is loaded with carbon.

5. An apparatus according to claim 4 wherein the wheels are so mounted that any static electricity generated between the wheels and the sheet material is dissipated by conduction.

* * * * *